US005256033A

United States Patent [19]

Kajiwara

[11] Patent Number: 5,256,033

[45] Date of Patent: Oct. 26, 1993

[54] SHEET METAL INTERSTAGE CASING FOR A PUMP

[75] Inventor: Ken-ichi Kajiwara, Tokyo, Japan

[73] Assignee: Ebara Corporation, Tokyo, Japan

[21] Appl. No.: 811,068

[22] Filed: Dec. 20, 1991

[30] Foreign Application Priority Data

Nov. 25, 1990 [JP] Japan ..... 2-405851
Dec. 27, 1990 [JP] Japan ..... 2-402363

[51] Int. Cl.[5] ..... F01D 25/24

[52] U.S. Cl. ..... 415/214.1; 415/182.1; 415/199.1

[58] Field of Search ..... 415/214.1, 200, 199.1, 415/199.2, 199.3, 182.1, 215.1

[56] References Cited

U.S. PATENT DOCUMENTS 4,549,849 10/1985 Jensen et al. ..... 415/182.1
4,877,372 10/1989 Jensen ..... 415/214.1
4,923,367 5/1990 Zimmer ..... 415/214.1

FOREIGN PATENT DOCUMENTS 557444 5/1958 Canada ..... 415/199.3
0055426 7/1982 European Pat. Off. .
3729673 3/1989 Fed. Rep. of Germany ... 415/199.1
3826280 11/1989 Fed. Rep. of Germany ... 415/199.1
917844 1/1947 France ..... 415/199.3
91395 6/1982 Japan ..... 415/198.1
62-251497 11/1987 Japan .
291495 12/1987 Japan ..... 415/199.3
63-170593 7/1988 Japan .

OTHER PUBLICATIONS

European Pat. 267,445, May 1988.

*Primary Examiner*—John T. Kwon
*Attorney, Agent, or Firm*—Wenderoth, Lind & Ponack

[57] ABSTRACT

A multistage centrifugal pump has a plurality of series-connected interstage casings of pressed sheet metal housing respective impellers. Each of the interstage casings includes a cylindrical side wall for housing an impeller, a bottom wall joined to the cylindrical side wall and extending around an inlet for the impeller, and a return blade attached to the bottom wall remotely from the impeller. The bottom wall has a central region projecting conically or spherically radially inwardly toward the impeller by a distance corresponding to the extent to which the bottom wall is deformable under an interstage pressure difference. The deformation of the bottom wall that is developed under the pressure generated by the impeller is borne only by the casing body itself without affecting the welded spots, which are prevented from being ripped off under stresses that would otherwise concentrate on the welded spots.

11 Claims, 4 Drawing Sheets

FIG. 2 - PRIOR ART
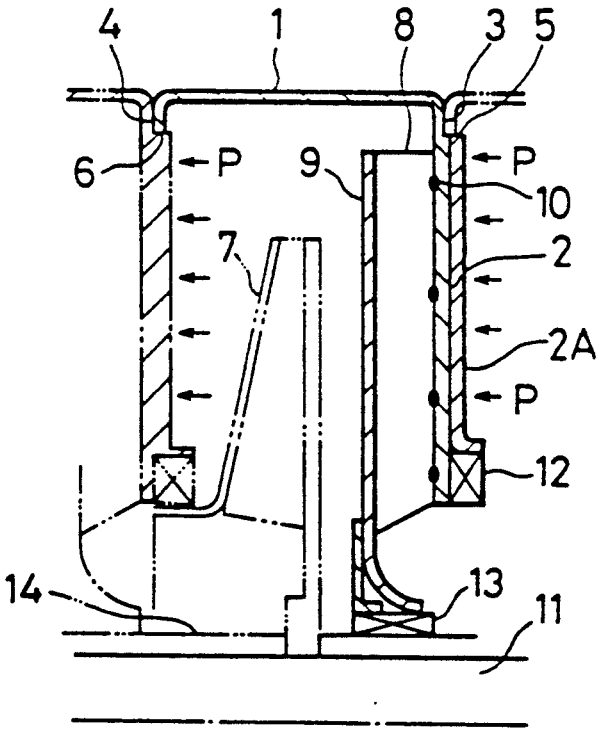

FIG. 3 - PRIOR ART
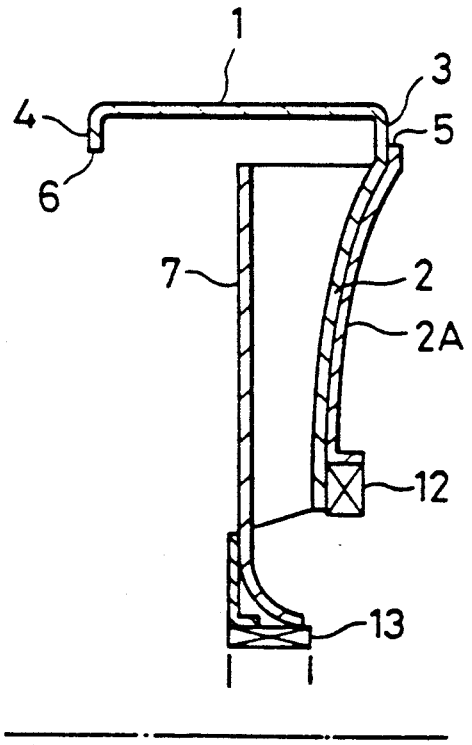

FIG. 4 - PRIOR ART
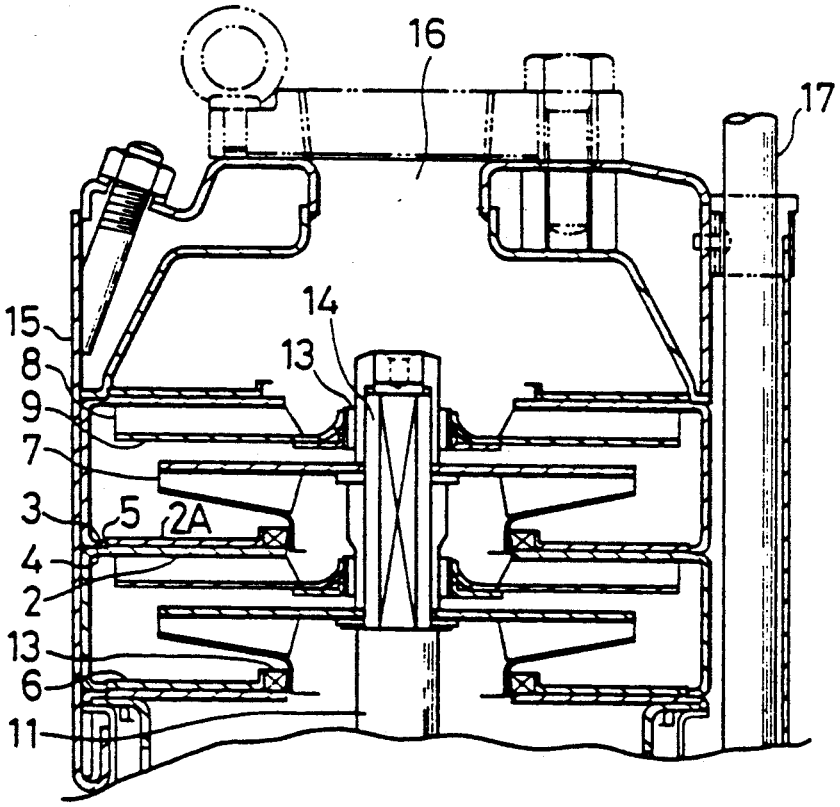

SHEET METAL INTERSTAGE CASING FOR A PUMP

BACKGROUND OF THE INVENTION

The present invention relates to a sheet metal interstage casing for a pump a sheet metal, and more particularly to an interstage casing for a pump which is pressed into shape for use in a multistage centrifugal pump.

Conventionally, there is known an interstage casing for a pump in which the casing is formed of sheet metal such as a stainless steel plate and manufactured by press work.

This type of interstage casing is shown in FIG. 2 of the accompanying drawings. As shown in FIG. 2, the interstage casing is of a cylindrical receptacle-like structure comprising a cylindrical side wall 1 and a bottom wall (or casing end wall) 2 on an end thereof (on the right-hand side in FIG. 2) which is connected to a subsequent (or the next) interstage casing. The axial ends of the cylindrical receptacle-like structure are machined into a bottom end surface 3 joined to the bottom wall 2 and an open end surface 4. The bottom wall 2 has a radially outer cylindrical surface 5 to be fitted in the next interstage casing, providing a spigot joint. The open end surface 4 has a radially inner cylindrical surface 6 fitted over the radially outer cylindrical surface 5 of a preceding interstage casing, providing a spigot joint. These surfaces 5, 6 are also machined to desired dimensional accuracy.

The interstage casing houses a impeller 7 having an inlet end disposed in the opening of the cylindrical side wall 1 which is defined by the open end surface 4. That is, the inlet side of the impeller 7 is disposed in confronting relation to the bottom wall 2 of the preceding interstage casing. The interstage casing also accommodates a return blade 8 with a side plate 9 joined thereto, the return blade 8 being welded at plural spots 10 to the surface of the bottom wall 2 which faces the impeller 7.

The impeller 7 can be rotated by a shaft 11. A liner ring 12 is attached to the bottom wall 2. A shaft sleeve 14 is fitted over the shaft 11. The side plate 9 is mounted on the shaft sleeve 14 through a bearing or bushing 13.

When the multistage centrifugal pump is in operation, the liquid to be pumped is pressurized by the impeller 7, passes through a passage defined in the return blade 8 between the side plate 9 and the bottom wall 2, and is led to the next impeller by which the liquid is further pressurized. The pressure of the liquid is applied to the reverse side of the bottom wall 2 as indicated by the arrows P, tending to deform the bottom wall 2 radially inwardly toward the lower-pressure side (toward the left-hand side in FIG. 2).

If the bottom wall 2 is deformed to a large extent, then welded spots 10 between the return blade 8 and the bottom wall 2 may be subjected to excessive stresses that may rip off the welded spots 10. To prevent the bottom wall 2 from being deformed excessively, the interstage casing has a stiffener plate 2A welded to the bottom wall 2. The return blade 8, the side plate 9, and the bottom wall 2 are also increased in thickness to prevent them from being deformed excessively.

FIG. 3 of the accompanying drawings shows in cross section an interstage casing including a spherical bottom wall 2 which has a relatively thin wall thickness. Those parts shown in FIG. 3 which are identical or similar to those shown in FIG. 2 are denoted by identical or similar reference characters.

FIG. 4 of the accompanying drawings shows in fragmentary cross section a vertical-shaft multistage centrifugal pump comprising interstage casings each of the structure shown in FIG. 2. The interstage casings are assembled together by a fastening band 15. The multistage centrifugal pump includes a discharge port 16 and a cable 17.

When the multistage centrifugal pump is in operation, the liquid to be pumped is drawn from a suction port (not shown) and pressurized by the successive impellers 7. The pressure head of the liquid is restored as the liquid passes through each of the return blades 8. Finally, the liquid is discharged out of the pump through the discharge port 16.

Of various forces induced by the liquid pressure and pressure differences applied to the interstage casings, the most problematic would be the force imposed by the interstage pressure difference acting on a flat portion normal to the shaft between adjacent ones of the interstage casings. Heretofore, such force has not caused any substantial problem because the interstage casings have been formed by casting.

As described with reference to FIG. 2, however, the interstage casing pressed from sheet metal suffers various drawbacks when the bottom wall 2, which corresponds to the flat portion referred to above, is deformed. More specifically, the pressure P that has been increased by the impeller 7 is applied to the bottom wall 2, thus deforming the bottom wall 2 in the direction of the force p radially toward the lower-pressure side. When the bottom wall 2 is thus deformed, very large stresses are developed in the welded spots 10 between the bottom wall 2 and the return blade 8.

Consequently, the pressure that can be increased by a single impeller is determined by the extent to which the flat portion (bottom wall) is deformed. Therefore, the interstage casing cannot be greatly increased in size, and should require a considerable wall thickness.

On the other hand, the spherical bottom wall that has a spherical shape to thereby reduce deformation and is employed to make the thickness relatively thin, as shown in FIG. 3, is also disadvantageous in that the return passage for the liquid is not of a good shape, resulting in a reduction in the performance of the pump.

SUMMARY OF THE INVENTION

In view of the aforesaid conventional problems, it is an object of the present invention to provide an interstage casing made of sheet steel which is prevented from suffering problems due to the deformation of a bottom wall corresponding to a flat portion between adjacent interstage casings, caused by forces induced by the pressure difference generated between adjacent interstage casings, and which is particularly prevented from welded spots between the bottom wall and a return blade ripped off.

To achieve the above object, there is provided in accordance with the present invention a sheet metal interstage casing for a pump, comprising a cylindrical side wall for housing an impeller; and a bottom wall (or casing end wall) joined to the cylindrical side wall and extending around an inlet for the impeller. The bottom wall supports return blade attached thereto at the opposite side of the impeller. The bottom wall has a central region projecting conically or spherically axially inwardly toward the impeller by a distance corresponding to the extent to which the bottom wall is deformable under an interstage pressure difference.

The interstage casing further includes two side plates, the return blade being sandwiched and welded between the side plates and, defining a passage between the side plates. One of the side plates is welded to the bottom wall near an outermost peripheral portion thereof. The central region of the bottom wall is spaced from the one of the side plates by a gap.

With the above structure, during operation of the pump, the interstage pressure difference developed by the impeller is applied to the bottom wall. However, since the central region of the bottom wall projects conically or spherically axially inwardly toward the impeller by a distance corresponding to the extent to which said bottom wall is deformable under an interstage pressure difference, the distance and the extent to which the bottom wall is deformable substantially offset each other.

Consequently, the welded spots between the return blade and the side plate welded to the bottom wall are not affected by the deformation of the bottom wall. The welded spots are thus prevented from being ripped off under stresses which would otherwise concentrate on the welded spots.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

In the drawings:

FIG. 2 is a fragmentary cross-sectional view of one half of a conventional interstage casing;

FIG. 3 is a fragmentary cross-sectional view of one half of another conventional interstage casing; and FIG. 4 is a longitudinal cross-sectional view of a multistage centrifugal pump with conventional interstage casings.

DETAILED DESCRIPTION OF THE PREFERRED EMBODIMENT

Figure 1:
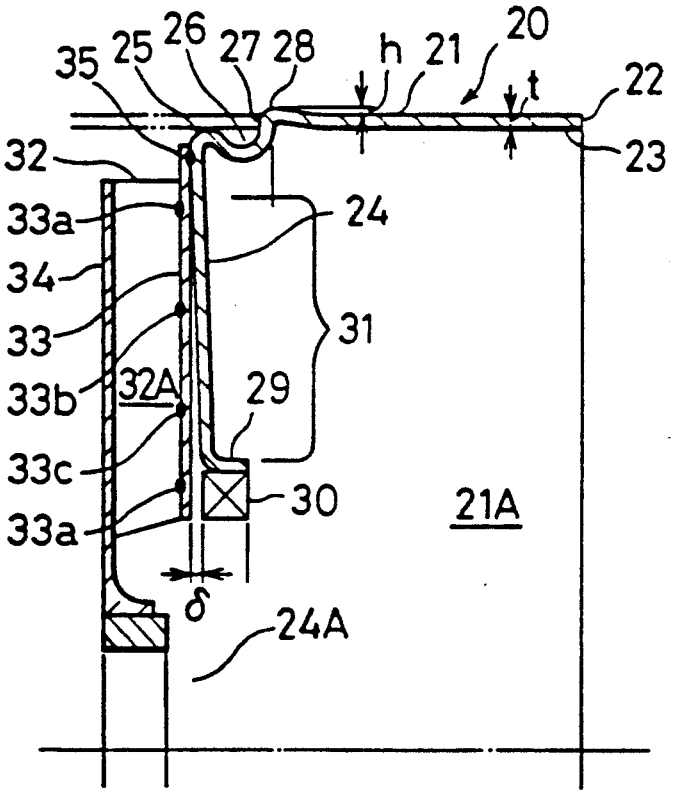
FIG. 1 is a fragmentary cross-sectional view of one half of an interstage casing according to an embodiment of the present invention.

A sheet metal interstage casing for a pump, according to an embodiment of the present invention will be described with reference to FIG. 1.

FIG. 1 shows in fragmentary cross section one half of an interstage casing according to an embodiment of the present invention. The interstage casing is formed of sheet metal such as a stainless steel plate and used particularly in a multistage centrifugal pump.

As shown in FIG. 1, an interstage casing is in the form of a deformed cylindrical receptacle-like body 20 comprising a cylindrical side wall 21 having a thickness t. The cylindrical side wall 21 has, around its opening, an end surface 22 and an inner surface 23 serving as the female member of a spigot joint. Between the cylindrical side wall 21 and a bottom wall (or casing end wall) 24, there are provided a cylindrical portion 25 joined to the bottom wall 24 and having an outside diameter slightly smaller than the inside diameter of the cylindrical side wall 21, a relief portion 26 smaller in diameter than the cylindrical portion 25, and a flat portion 27 joined to the relief portion 26 and serving as an end surface near the bottom wall 24. The cylindrical portion 25 serves as a male member of a spigot joint. The flat portion 27 and the cylindrical side wall 21 are integrally joined to each other through a projecting portion 28 projecting radially outwardly. The projecting portion 28 has an outside diameter larger than the outside diameter of the cylindrical side wall 21, providing a region to engage the end surface 22 of an adjacent interstage casing. The difference, 2h, between the outside diameters of the projecting 28 and the cylindrical side wall 21 is approximately twice the thickness t. The bottom wall (or casing end wall) 24 has a central flange 29 to which a liner ring 50 is attached. The liner ring 30 is spaced apart by a small gap from an inlet end of an impeller (not shown).

The bottom wall 24 of the interstage casing body 20 comprises a conical body 31 extending toward a hole 24A in which the liner ring 30 is inserted. Specifically, the central region of the bottom wall 24 projects toward a casing interior 21A in which an impeller is housed. The projecting distance $\delta$ is a predetermined dimension so that the side plate 33 adjacent to the bottom wall 24 is not deformed even if the bottom wall 24 is deformed by the pressure generated by the impeller. That is, the projecting distance $\delta$ is predetermined to ensure that the bottom wall 24 is caused to contact the side plate 33 adjacent to the bottom wall 24 either slightly or not at all. More specifically, the projecting distance $\delta$ is about 0.8 or more times the extent to which the bottom wall 24 can be deformed under the pressure developed by the impeller, and is sufficient to prevent the bottom wall 24 from coming excessively close to the impeller.

The pressure of the liquid that has been generated by a preceding impeller (shown on the left-hand side in FIG. 1) is introduced into a passage 32A defined in a return blade 32 of a guide vane sandwiched and welded between side plates 33, 34. The liquid is then guided from the passage 32A to a subsequent (or the next) impeller (not shown). The side plate 33 is welded or otherwise fixed to the bottom wall 24 near an outermost peripheral portion 35. The side plate 33 is welded to the return blade 32 at plural spots **33*a* through 33*d***.

During operation of the pump, the liquid flows through the return passage 32A in the preceding interstage casing (on the left-hand side in FIG. 1), and is introduced into the inlet of the non-illustrated impeller housed in the interstage casing 20. The liquid is then pressurized by the impeller, flows through the return blade passage adjacent to the impeller, and is introduced into the next impeller. At this time, the interstage pressure difference developed by the liquid pressure produced by the impeller acts o the inner surface of the bottom wall 24, tending to push the bottom wall 24 toward the return blade that is attached to the reverse side (lower-pressure side) of the bottom wall 24. However, the bottom wall 24 conically projects inwardly toward the impeller by the distance $\delta$. Consequently, the distance $\delta$ by which the bottom wall 24 projects and the extent to which it is deformed under the interstage pressure difference substantially offset each other.

The welded spots **33*a* through 33*d* between the return blade 32 and the side plate 33 that is joined to the bottom wall 24 at a position remote from the impeller and close to the outermost peripheral portion 35, are not subjected to the influence of the deformation of the bottom wall 24**. These welded spots are thus prevented from being ripped off by stresses that would otherwise be developed.

In the above embodiment, the interstage casing body 20 has the relief portion 26 lying between the bottom wall 24 and the cylindrical side wall 21, joined to the bottom wall 24, and having an outside diameter slightly smaller than the inside diameter of the cylindrical side wall 21. However, the present invention is also applicable to an interstage casing that dispenses with the relief portion 26.

The same advantages as those described above can be attained if the central region of the bottom wall 24 projects spherically.

Alternatively, the region of the bottom wall 24 radially inward of the outermost peripheral portion 35 may be of a concave shape such that it is spaced from the side plate by a gap.

As described above, according to the present invention, the central region of the bottom wall projects conically or spherically by a distance that corresponds to the extent to which the bottom wall is deformed under the interstage pressure difference. Therefore, the deformation of the bottom wall that is developed under the pressure generated by the impeller is borne by only the casing body itself, without affecting the welded spots. Accordingly, the welded spots are prevented from being ripped off. The return blade, or the return blade section of a guide vane, is sandwiched and welded between the side plates, defining the passage for the liquid to be pumped, and one of the side plates is welded to the bottom wall of the interstage casing body near the outermost peripheral portion. The welded spots between the return blade and the side plate are prevented from being ripped off under stresses which would otherwise concentrate on the welded spots.

Since the passage defined in the return blade is not subject to forces under the liquid pressure, the return blade and the side plates may be of suitable thickness, thus reducing the weight and cost of the interstage casing.

Although a certain preferred embodiment of the present invention has been shown and described in detail, it should be understood that various changes and modifications may be made therein without departing from the scope of the appended claims.

What is claimed is:

1. A sheet metal interstage casing for a pump having a central rotational axis and an impeller, said casing comprising:

a cyclindrical side wall for housing the impeller, said cylindrical side wall being adapted to be mounted coaxially with the central rotational axis of the pump;

an annular casing end wall joined to a first end of said cylindrical side wall and extending radially inwardly from said cylindrical side wall, such that said cylindrical side wall extends away from said casing end wall in a first direction;

a return blade fixed to an outer periphery of said casing end wall and extending radially inwardly, said return blade being disposed on an opposite side of said casing end wall relative to said cylindrical side wall; and wherein a radially inner portion of said casing end wall is offset in said first direction from said outer periphery thereof and from said return blade, such that a gap is formed between said inner portion of said casing end wall and a radially inner portion of said return blade.

2. An interstage casing as recited in claim 1, wherein said casing end wall is inclined, from said outer periphery thereof, radially inwardly and toward said first direction, such that said casing end wall has a conical shape.

3. An interstage casing as recited in claim 1, further comprising two side plates, said return blade being sandwiched and welded between said two side plates and defining a passage between said two side plates;

wherein one of said two side plates is welded to said casing end wall at said outer periphery of said casing end wall; and wherein said radially inner portion of said casing end wall is spaced from said one of said two side plates by a gap.

4. An interstage casing as recited in claim 1, wherein said casing end wall has a central flange on its radially inner edge, said flange extending in said first direction from said casing end wall and constituting a supporting member for supporting a liner ring.

5. An interstage casing as recited in claim 1, wherein between said cylindrical side wall and said casing end wall, there is provided a cylindrical portion joined to said casing end wall and having an outside diameter slightly smaller than an inside diameter of said cylindrical side wall, said cylindrical portion constituting a male member of a spigot joint; and said cyclindrical side wall has an open end portion so as to constitute a female member of a spigot joint.

6. A multistage centrifugal pump comprising:

a rotatable shaft;

a plurality of impellers supported by said shaft; and a plurality of series-connected interstage casings for enclosing said impellers, respectively, each of said interstage casings comprising:

a cylindrical side wall for housing the impeller, said cylindrical side wall being adapted to be mounted coaxially with the central rotational axis of the pump;

an annualar casing end wall joined to a first end of said cylindrical side wall and extending radially inwardly from said cylindrical side wall, such that said cyclindrical side wall extends away from said casing end wall in a first direction;

a return blade fixed to an outer periphery of said casing end wall and extending radially inwardly, said return blade being disposed on an opposite side of said casing end wall relative to said cylindrical side wall; and wherein a radially inner portion of said casing end wall is offset in said first direction from said outer periphery thereof and from said return blade, such that a gap is formed between said inner portion of said casing end wall and a radially inner portion of said return blade.

7. A multistage centrifugal pump as recited in claim 6, wherein for each of said interstage casings, said casing end wall is inclined, from said outer periphery thereof, radially inwardly and toward said first direction, such that said casing end wall has a conical shape.

8. A sheet metal interstage casing for a pump having a central rotational axis, said casing comprising:

a cylindrical side wall for housing the impeller, said cylindrical side wall being adapted to be mounted coaxially with the central rotational axis of the pump;

a casing end wall joined to a first end of said cylindrical side wall and extending radially inwardly from said cylindrical side wall, such that said cylindrical side wall extends away from said casing end wall in a first direction;

wherein a radially inner portion of said casing end wall is offset in said first direction from an outer periphery thereof, such that a gap is formed between said radially inner portion of said casing end wall and a plane which is perpendicular to said cylindrical side wall and to the central rotational axis and extends through said outer periphery of said casing end wall;

wherein said cylindrical side wall includes, at said first end thereof, a reduced diameter portion constituting a male member of a spigot joint; and wherein said cylindrical side wall further includes a radially outwardly projecting portion adjacent said reduced diameter portion and constituting a limiting member for limiting movement of a female member of the spigot joint in said first direction.

9. An interstage casing as recited in claim 8, wherein said casing end wall is inclined, from said outer periphery thereof, radially inwardly and toward said first direction, such that said casing end wall has a conical shape.

10. A multistage centrifugal pump comprising:

a rotatable shaft;

a plurality of impellers supported by said shaft; and a plurality of series-connected interstage casings for enclosing said impellers, respectively, each of said interstage casings comprising:

a cylindrical side wall for housing the impeller, said cyclindrical side wall being adapted to be mounted coaxially with the central rotational axis of the pump;

a casing end wall joined to a first end of said cylindrical side wall and extending radially inwardly from said cylindrical side wall, such that said cylindrical side wall extends away from said casing end wall in a first direction;

wherein a radially inner portion of said casing end wall is offset in said first direction from an outer periphery thereof, such that a gap is formed between said radially inner portion of said casing end wall and a plane which is perpendicular to said cylindrical side wall and to the central rotational axis and extends through said outer periphery of said casing end wall;

wherein said cylindrical side wall includes, at said first end thereof, a reduced diameter portion constituting a male member of a spigot joint; and wherein said cylindrical side wall further includes a radially outwardly projecting portion adjacent said reduced diameter portion and constituting a limiting member for limiting movement of a female member of the spigot joint in said first direction.

11. A multistage centrifugal pump as recited in claim 10, wherein for each of said interstage casings, said casing end wall is inclined, from said outer periphery thereof, radially inwardly and toward said first direction, such that said casing end wall has a conical shape.

* * * * *

UNITED STATES PATENT AND TRADEMARK OFFICE

CERTIFICATE OF CORRECTION

PATENT NO. : 5,256,033

DATED : October 26, 1993

INVENTOR(S) : Ken-ichi KAJIWARA et al.

It is certified that error appears in the above-indentified patent and that said Letters Patent is hereby corrected as shown below:

On the cover page, in item [75], "Ken-ichi Kajiwara, Tokyo, Japan" should read --Ken-ichi Kajiwara, Tokyo, Japan; Kikuichi Mori, both of Tokyo, Japan--;

In claim 6, column 6, line 41, "annualar" should read --annular--.

Signed and Sealed this

Twenty-eighth Day of June, 1994

Bruce Lehman

*Attest:*

BRUCE LEHMAN

*Attesting Officer*

*Commissioner of Patents and Trademarks*